US006964394B1

(12) United States Patent
Räty et al.

(10) Patent No.: US 6,964,394 B1
(45) Date of Patent: Nov. 15, 2005

(54) REEL-UP AND METHOD FOR REELING OF A WEB

(75) Inventors: Jarkko Räty, Järvenpää (FI); Jussi Lundberg, Ruuhijärvi (FI); Pekka Ruha, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/720,228

(22) PCT Filed: Jun. 17, 1999

(86) PCT No.: PCT/FI99/00528

§ 371 (c)(1),
(2), (4) Date: Dec. 18, 2000

(87) PCT Pub. No.: WO99/65806

PCT Pub. Date: Dec. 23, 1999

(30) Foreign Application Priority Data

Jun. 18, 1998 (FI) ..... 981427

(51) Int. Cl.[7] ..... B65H 18/10
(52) U.S. Cl. ..... 242/541; 242/542.4; 242/541.6; 242/542.3
(58) Field of Search ..... 242/541.1, 542.3

(56) References Cited

U.S. PATENT DOCUMENTS

| | | | | |
|---|---|---|---|---|
| 3,834,642 A | | 9/1974 | Kampi | 242/75.5 |
| 4,049,212 A | | 9/1977 | Yamaguchi et al. | 242/56.9 |
| 4,634,068 A | | 1/1987 | Malkki et al. | 242/65 |
| 5,249,758 A | | 10/1993 | Müller et al. | 242/65 |
| 5,251,835 A | * | 10/1993 | Kyytsonen | 242/533.2 |
| 5,285,979 A | | 2/1994 | Francesco | 242/65 |
| 5,370,327 A | | 12/1994 | Adamski | 242/533.1 |
| 5,377,931 A | | 1/1995 | Dörfel et al. | 242/530 |
| 5,393,008 A | | 2/1995 | Kyytsönen et al. | 242/541.1 |
| 5,673,870 A | | 10/1997 | Fielding et al. | 242/542.3 |
| 5,690,298 A | | 11/1997 | Rück | 242/542.3 |
| 5,845,868 A | | 12/1998 | Klerelid et al. | 242/541 |
| 5,967,449 A | * | 10/1999 | Thomas et al. | 242/541.1 |

FOREIGN PATENT DOCUMENTS

| | | | |
|---|---|---|---|
| DE | 1225014 | 9/1966 | B65H 5/10 |
| DE | 4201326 | 7/1993 | B65H 18/02 |
| EP | 0502434 | 9/1992 | B65H 18/26 |
| EP | 0819638 | 1/1998 | B65H 18/26 |
| GB | 2209519 | 5/1989 | B65H 18/26 |
| JP | 60112555 | 6/1985 | B65H 18/20 |
| WO | 9855384 | 12/1998 | B65H 18/26 |

* cited by examiner

*Primary Examiner*—Donald P. Walsh
*Assistant Examiner*—Jonathan R Miller
(74) *Attorney, Agent, or Firm*—Steinberg & Raskin, P.C.

(57) ABSTRACT

The invention relates to a method for reeling of a web, in which the web is reeled around a reel spool. In the invention, the reel spool rests and/or it is supported substantially during the entire "nip closed" reeling process of the reeling device, substantially in its position with respect to the same supporting surface.

17 Claims, 8 Drawing Sheets

REEL-UP AND METHOD FOR REELING OF A WEB

FIELD OF THE INVENTION

The present invention relates to a method for reeling a web around a reeling spool. The invention also relates to a reel-up for a web. The invention also relates to a method for reeling a web around a reel spool by means of said reel-up.

BACKGROUND OF THE INVENTION

There are known reel-ups of a paper machine or the like in which the web to be reeled is guided over a reeling cylinder, through a nip formed by the reeling cylinder and the reel being formed, and onto the reel that is being formed. Typically the reel that is being formed is completed around a so-called reel spool which is supported at its ends by means of bearings on so-called reeling rails along which the reel spool and the roll thereon are capable of rolling by means of bearing housings.

Reel-ups of web-like materials are used to reel a material passed in a continuous web into a tight reel, so that it can be moved to further processing. In reel-ups of a paper web, a continuous paper web passed from a paper machine, coating machine or corresponding paper processing apparatus is reeled around a reeling axle, i.e. reel spool, to form a reel. For example, in a so-called Pope-reeler, or in a center-drive assisted Pope-reeler, the finished paper is reeled around the reeling axle after the calender. The web is passed to the reel via a rotatably arranged reeling cylinder, against which the reeling axle is loaded by means of a loading device located in connection with the reeling axle.

The web is passed to the reeling axle so that it is pressed against the preceding layers of the reel and the mantle surface of the reeling cylinder. At this point where the web enters in contact with the preceding layers on the reel, the web is, due to the aforementioned loading device, subjected to a certain nip load, linear load. In present-day reel-up types, the reeling axle is also centre-driven, and by means of the torque of the reeling axle it is also possible to affect the peripheral force of the reel to be reeled. The reeling nip between the reeling cylinder and the reel primarily prevents the access of air to the reel. By controlling the load directed to the web, it is, however, also possible to control the tightness of the reel that is being formed, and in addition, the aim is to change the loading during the reeling process so that the tightness of the reel would comply with the quality requirements set by the paper grade and the after-treatment in different sections in the radius of the reel. The reeling process is controlled indirectly by adjusting the reeling parameters (linear load, web tension, peripheral force and reeling force). The adjustment is typically made with a special program. The main aim of the reeling is to reel a continuous paper web to form a reel which fulfills the requirements set by the reeling process and further processing with respect to processibility and thereby the structure of the reel as well as the paper quality. At present, the speeds of paper machines are typically 20 m/s or higher, and naturally, the aim is to attain speeds which are even higher. The reeling apparatus must operate without interruptions and receive the continuous paper web passed from the preceding sections of the paper machine.

When the old reel has become full, the web has to be cut and the winding of the web following the cut-off point around a new reeling axle has to be started. In practice, this takes place in such a way that when the paper roll formed around the reeling axle has accumulated into its full size, a new empty reel is transferred, typically simultaneously and from above the reeling cylinder, onto the surface of the reeling cylinder, while the paper web is left therebetween. The full paper reel is transferred away from the reeling cylinder, and thereafter the paper web is cut with a suitable way and the end of the web following the cut-off point is guided onto the perimeter of an empty reeling axle, onto which the new web begins to accumulate to form a reel. Thereafter the new reeling axle is transferred to a reeling carriage, travelling on separate linear guides, or on top of horizontal reeling rails. The reel that has become full is transferred e.g. by means of a transfer device along the reeling rails to an unloading station, and at the same time a new reeling axle is brought onto the reeling rails. During the initial reeling process the loading is controlled by means of force devices of the initial reeling device, and when the reeling axle has been transferred e.g. to the reeling carriage, the loading is controlled by means of force devices coupled to the reeling carriage, typically by means of pressurized medium operated cylinders.

For example U.S. Pat. No. 4,634,068 discloses a reeling apparatus in which an empty roll is lowered in contact with the reeling cylinder. Furthermore, a separate mention is to be given to the force devices of the initial reeling device in the U.S. Pat. No. 4,634,068, i.e. a separate loading cylinder and a relief cylinder, and when the reeling axle is on top of the reeling rails, to a loading cylinder which presses the axle against the reeling cylinder. The used hydraulic cylinder is coupled e.g. to swinging arms articulated turnable in the frame of the reel-up.

The properties of the web affect the quality of the reel. For example, the most common reeling problem caused by a bad web tension is the wrinkling of the slack parts of the web, typically the edges, in the reeling nip or nips, because the web is longer by the slack section than by the tight section. The slackness of the edges also causes a poor edge zone in the reel and thereby edge reels of poor quality which are difficult to be reeled by means of slitter winders, and whose problems occur when the rolls are used, for example in printing machines. If the web tension profile varies a great deal or is e.g. uneven, it may lead to the use of high web tension just in case, which stresses the tight sections in the web more and increases the number of web breaks.

In a control circuit of a reel-up which is disclosed in the U.S. Pat. No. 5,285,979, the loading takes place in the frame of the reel-up by means of a carriage moving along linear guides in the frame of the reel-up, to which carriage the loading force device is coupled. In the publication, the reeling axle is arranged in a swinging arm articulated turnable in the carriage, which swinging arm, however, is stationary during the loading and is only used when the reel that has become full is removed by turning the swinging arms to the direction of removal by means of special unloading cylinders. The aforementioned force device is used to supply the desired loading force or to transfer the reeling axle further away from the reeling cylinder as the size of the roll grows. In the initial reeling device this can also take place by means of separate relief cylinders, as is presented in the U.S. Pat. No. 4,634,068. By means of relief cylinders it is possible to compensate the effect of gravity on the reeling cylinder, and thus they are used for so-called profiling. It is also common that in the initial reeling device the loading, relieving and adjustment of the position of the reeling axle with respect to the reeling cylinder are effected by means of one double-acting pressurized medium operated cylinder.

The U.S. Pat. No. 5,285,979 also describes the use of a hydraulic cylinder separately in a situation where the reeling cylinder and the growing reel are kept within a distance from each other, wherein a photocell is used to produce the signal effecting the transfer. The actual loading force is affected by several factors, such as friction caused by the motion of the force device as well as kinetic friction of the structure supporting the reeling axle when it is moved. It should also be noted that the current regulator means is a servo valve which controls the cylinder functioning as a force device, whereas the cylinder controls only one of the two carriages.

There are also known reel-ups such as the one presented in EP patent 604558 and in the related U.S. Pat. No. 5,393,008. The patent discloses carriages arranged movable linearly in guides parallel to the reeling rails, the position of the carriages being determined on the basis of hydraulic cylinders coupled between the frame of the reel-up and the carriages. Thus, by means of these hydraulic cylinders, the location of the reeling axle is at the same time also adjusted with respect to the reeling cylinder. The carriages are provided with separate pressing devices which press the bearing housings located at the ends of the reeling axle and resting on the reeling rails with an adjustable force towards the reeling cylinder to produce the necessary nip pressure. On the other side of the bearing housing, the carriages are also provided with positioning devices by means of which the location of the reeling axle in the carriage can be adjusted more accurately.

In the above-described cases to control e.g. the reeling carriage, the initial reeling device and the loading device, hydraulic cylinders are typically used in pairs to control the different ends of the reeling axle. Thus, the control of the ends is arranged for example by means of an integrated carriage or a carriage arranged in connection with each end to move independently. Furthermore, it is thus possible to arrange the linear load between the machine reel and the reeling cylinder to vary also in the transverse direction of the paper web. On the basis of the above-described facts it is obvious that for the sake of reliable function, the control of the force devices must also be reliable and simple.

There are, however, considerable problems and drawbacks related to the prior art. Thus, such reel-ups entail factors which disturb the reeling process. The rolling surfaces of the reel spools which thus function as surfaces transmitting e.g. supporting force in the support of the reel during the reeling, are subjected to considerable stress when the reel spools are manipulated and driven. These surfaces can also be damaged with time, which impairs the situation even more. Even though the surfaces remained in a relatively good shape, friction is always produced in the rolling which friction is also affected by the mass of the constantly growing reel. This friction also affects the control of the reeling process, such as the adjustment of the linear load.

Thus, in the reeling of a web, particularly as the reel is accumulated, the most significant disturbance factors in the linear load and its control include the changes in the frictions produced as a result of the transfer of the machine reel, i.e. the reel spool.

The essential steps of the reeling process include the change of the reel and the act of stopping the rotary movement of the reel. Thus, as the reel-up in question is a continuous reel-up, the reel has to be removed from the nip contact i.e. from the reeling cylinder constituting the actual reeling nip, at least when stopping the reel. Thus, it is advantageous to form a separate nip by means of a pressing device to bind the surface layers of the reel and to prevent the access of air between the layers of the reel. A pressing device of this kind, such as a roll is, however, impractical with respect to the movement of the operating personnel, because it is typically placed slightly above the machine level. Such a pressing device can be placed and supported by means of an apparatus, such as a slide structure or guides, which is movable separately, wherein it can be driven to the front, i.e. in the vicinity of the reeling cylinder. Such a solution is, however, complicated, and it increases the sequence times.

OBJECTS AND SUMMARY OF THE INVENTION

Thus, it is an object of the invention to present a new solution for this problem, with which solution the drivability of the reel-up is better than before and the structure is simpler.

It is an aim of the present invention to eliminate the drawbacks of prior art and to attain an entirely new solution with which the control of the reeling process is improved. The present invention provides a completely new kind of possibility to control the entire reeling process especially in reel-ups in which the reeling to a new reel spool is started with a first support apparatus, such as a so-called initial reeling device, and the reeling is continued with a second support apparatus, i.e. the member supporting/loading the reel spool and the reel is changed during the reeling.

Also in such reel-ups in which, at the change situation or when a full reel is stopped, the reel has to be removed from the actual reeling nip (even though a second pressing device is alternatively brought in nip contact with the reel) without moving the reel itself, the present invention provides an effective solution for controlling the reeling process comprehensively.

The invention is based on the idea that the reel spool rests and/or it is supported substantially during the entire "nip closed" reeling process of the reeling cylinder substantially in its position with respect to the same supporting surface.

The present invention relates to a method for reeling a web around a reeling spool. The invention also relates to a reel-up for a web. The invention also relates to a method for reeling a web around a reel spool by means of said reel-up.

Within the scope of the present invention, a paper machine refers, in addition to the actual paper machine, to paperboard and pulp drying machines and other corresponding machines as well as further processing machines for paper, such as coating machines or calenders, etc., and paper refers to all web-like materials that can be manufactured with all these devices.

According to a first preferred embodiment of the invention, a reel-up of a paper machine comprises at least a reeling cylinder supported rotatably and equipped with a drive, or a corresponding reeling means constituting a supporting surface, over which the web travels during the reeling and which forms a nip with the reel that is being formed at least for a part of the duration of the reeling. Corresponding reeling means guiding the web include e.g. a belt, a wire loop or a belt roll system. According to the invention, substantially immediately after or before the change of the reel (i.e. at least within a period of time which does not have a substantially harmful effect on the progress of the reeling), which can be conducted with methods and devices known as such, an empty reel spool onto which the reeling is transferred is brought in contact with the supporting surface on which the reel spool rests and/or is supported substantially during the entire reeling process substantially in its position with respect to the same supporting surface. According to the invention, this supporting surface is arranged in a means, such as a slide or the like, which is arranged movable on a supporting structure placed in the vicinity of the reeling cylinder, which supporting structure advantageously extends in the travel direction of the paper and is arranged in the vicinity of both ends of the reeling cylinder.

According to the invention, during the reeling process the reel spool and the roll located or formed thereon is thus supported by a supporting surface which is arranged to move away from the reeling cylinder as the reel to be reeled accumulates. Thus, the reel spool does not roll during the reeling, wherein the nip between the reel being formed and the reeling cylinder is kept closed, but the reel spool is transferred in a controlled manner on the support of the slide and advantageously by means of a separate reeling carriage, if necessary.

The reel-up according to a preferred embodiment of the invention comprises at least a reeling cylinder or the like as well as supporting structures arranged perpendicular to the cylinder, in the vicinity or the ends of the same, to support the reel spool and the reel that is bing formed during and after the reeling. According to one embodiment of the invention, the supporting structures for supporting the reel spool and the reel that is being formed comprise an assembly of supporting devices which comprises at least a part of the bearer surface in the upper surface of the supporting structure or a corresponding surface on which the reel spool and the roll located thereon can roll, and at least a second part of a supporting surface, such as a slide or a corresponding arrangement. The supporting surface is movable with respect to the reeling cylinder from the operating vicinity of the reeling cylinder to the vicinity of the bearer surface or a corresponding surface are substantially on the same vertical level. According to the invention, the reel spool and the roll formed thereon are supported by means of a supporting surface movable during the reeling process, and during and/or after the reel change the complete reel can be rolled via the bearer surface or a corresponding surface.

As far as the main principle of the reeling process is concerned, it is possible to utilize known methods and devices. At the stage of starting the reeling, when reeling onto a new reel spool, it is, according to the invention, possible to lower a new reel spool directly on a movable supporting surface, such as a slide, which has already been guided in the initial position (to the front). When the reel accumulates, the reel spool is not, according to the invention, rolled on the rails, but it is moved in the slide on linear guides when necessary. Thus, the reel spool is supported during the entire reeling process substantially in its position with respect to the same supporting surface. At the final stages of the "nip closed" reeling, the slide containing the supporting surface has moved in connection with stationary rails, wherein they are coupled to each other in such a way that the reel spool and the roll can be rolled over the interface therebetween. When the reeling nip between the reeling cylinder and the reel is opened in a change situation, the reel spool is transferred away from the movable supporting surface to rail members, such as stationary rails or the like, wherein the movable supporting surfaces are transferred to the front to the initial position in the vicinity of the reeling cylinder, wherein a new reel spool can be lowered directly on top of the movable supporting surface.

By means of the invention considerable advantages are achieved. With the solution according to the invention, the conditions can be controlled significantly better as the frictions are practically constant and thus the conditions are stabilized by means of the invention. With the method according to the invention, it is possible to efficiently control the reeling process with the reel changes and to minimize the disturbance factors. The reel-up according to the invention becomes safer and more user-friendly.

BRIEF DESCRIPTION OF THE DRAWINGS

In the following, the invention will be described in more detail with reference to the appended drawings, in which.

DETAILED DESCRIPTION OF THE PREFERRED EMBODIMENTS

Figure 1:
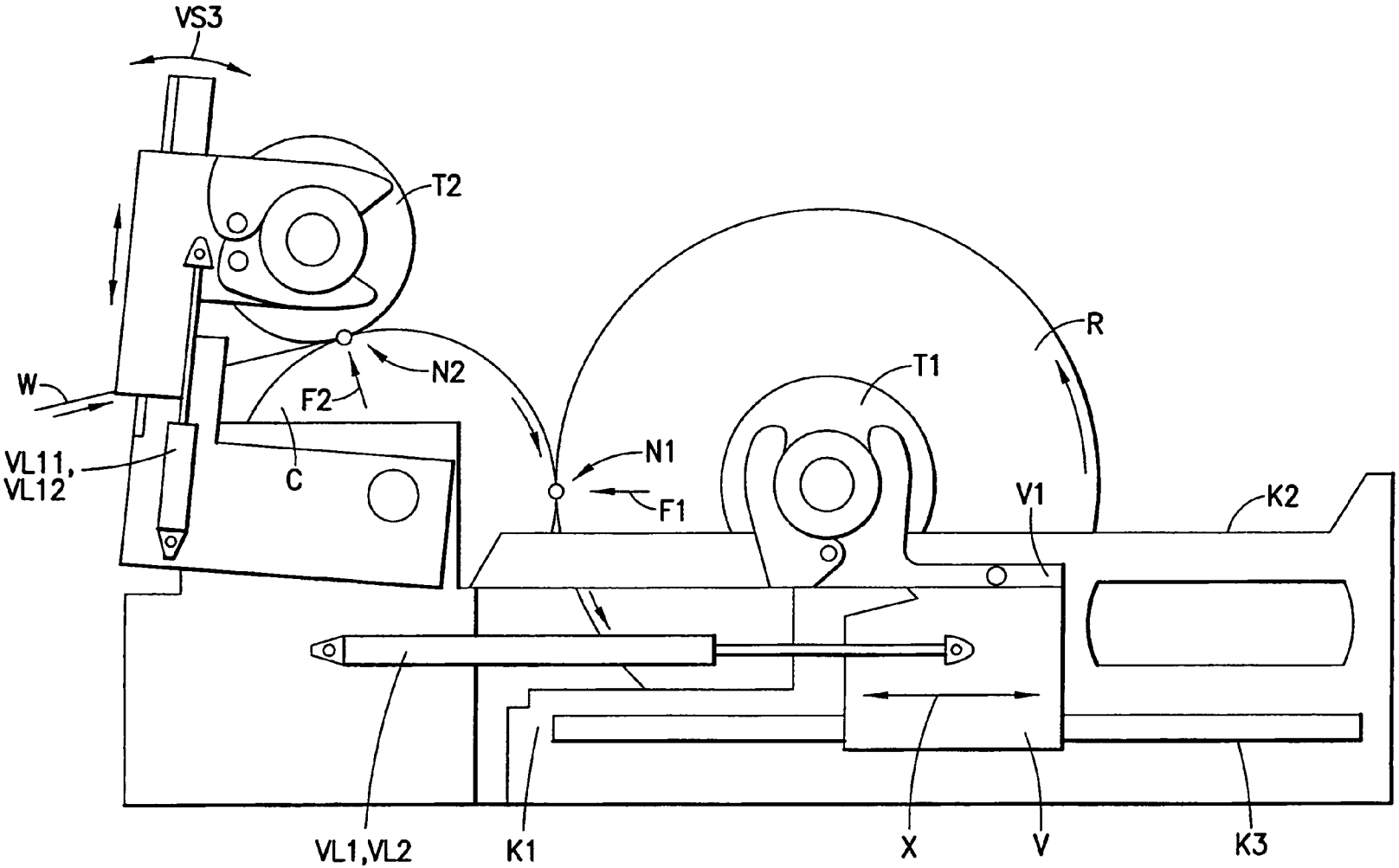
FIG. 1 PRIOR ART
FIG. 1 shows a side-view of a prior art reel-up of a web.

FIG. 1 is a reduced principle view showing in a side view a reel-up of a paper web, known as such. As is well known, the reel-up is provided with a rotatable reeling cylinder C, by means of which a continuous paper web W passed from a paper machine, coating machine or another paper processing apparatus is reeled around a reeling axle T1 to form a machine reel R. The reel R is loaded against the reeling cylinder C by applying a force F1 of desired strength, directed towards the reeling cylinder C, to the reeling axle T1. This produces a reeling nip N1 between the reel R and the reeling cylinder C, where a nip pressure of particular strength prevails as a result of the loading. The reeling axle T1 is advantageously also provided with a centre-drive, wherein the reel-up in question is a centre-drive assisted Pope reel-up, in which the torque of the reeling axle T1 can also be used to affect the quality of the reel R being formed. FIG. 1 also shows a reeling axle T2 brought in connection with the reeling cylinder C by means of an initial reeling device of the reel-up. The reeling axle T2 is loaded against the reeling cylinder C by applying a force F2 of desired strength directed towards the reeling cylinder C, to the reeling axle T2. This produces a reeling nip N2 between the reeling axle T2 and the reeling cylinder C, where a nip pressure of particular strength prevails as a result of the loading. In this case, the nip pressure is also affected by the weight of the reeling axle T2.

The reeling cylinder C is pivoted in a way known as such to a frame K1 of the reel-up, stationary with respect to a supporting base, such as the floor level of a factory. The reeling axle T1, in turn, is pivoted in a way known as such on top of reeling rails K2 on the support of which the ends of the reeling axle T1 rest at the bearing housings, and which at the same time support the weight of the reel R. By means of supports V1 of a carriage V, pivoted in a way known as such and moving in a guide K3 located in the frame K1, the reeling axle T1 and at the same time the reel R are moved in the longitudinal direction (arrow X) of the reel-up. The carriage V also moves in the longitudinal direction of the reel-up and it is of such a type that excluding a weight possibly received by the reeling cylinder C, the reeling rail K2 supports the entire weight of the reeling axle T1 and the reel R. The carriage V is arranged in a way known as such to move in linear direction with respect to the reeling cylinder C to transfer the reel R, and the motion is possible in both directions; in other words, if necessary, the carriage V can be moved back and forth (arrow X) by means of double-action cylinders. The carriage V can move on top of fixed linear guides or it can be guided by rails. The support V1 or its parts, articulated in the carriage V to turn with respect to a pivot located therein, can also be transferred by means of separate hydraulic cylinders (not shown in the drawing), e.g. to move the completed reel away from the carriage V.

With reference to FIG. 1, to attain the desired nip load (nip pressure), the reel R is loaded against the reeling cylinder C with a predetermined loading force F1 by affecting the reeling axle T1 by means of force devices VL11 and VL2, hereinafter also called an actuator VL1 or VL2. A loading force F2 is attained in a similar manner by means of force devices VL11 and VL12. The force devices VL1 and VL2, one on each side of the reel R in a similar manner as force devices VL11 and VL12, affect the bearing housings of the reeling axle T1 in a way known as such, which bearing housings are typically located in the carriage V or on the support of reeling rails. Hereinafter, the term actuator VL11 or VL12 will also be used for the force device VL11 or VL12. The reeling axle T1, in turn, is transferred further away from the reeling cylinder C when the reel R grows, i.e. when the radius of the reel R is increased, by moving the carriages V with the force devices VL1 and VL2. When the reeling proceeds, the desired nip load is attained by means of force devices VL1 and VL2, and the carriage V is moved as the thickness of the reel is increased. The reeling carriages V have to be moved in a synchronized manner, which sets special demands for the control circuit and the function of the force devices.

Figure 2A:
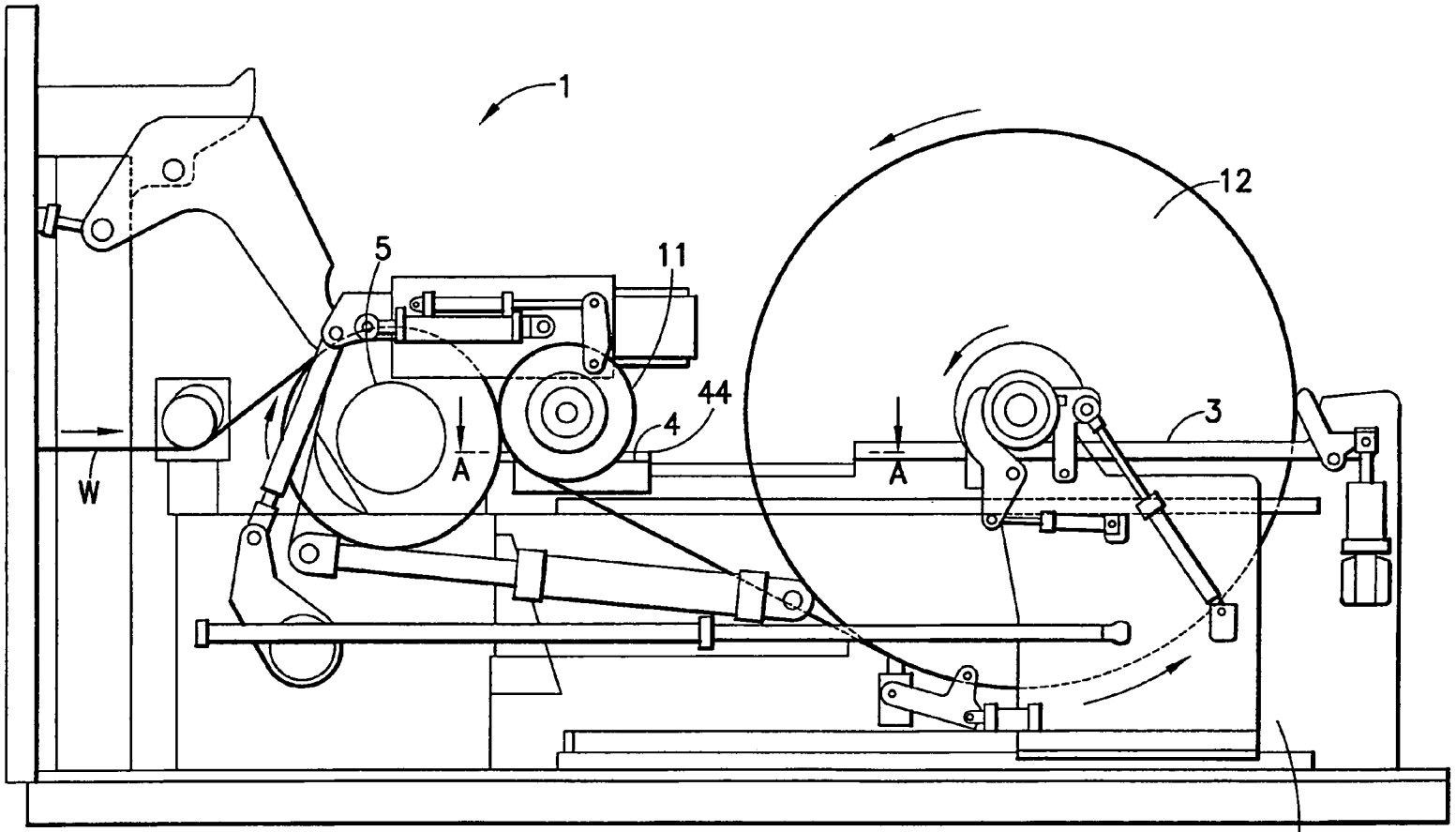
FIG. 2*a* shows as an example a side view of an embodiment of a solution according to the invention.

FIG. 2*a* is a skeleton diagram of the reel-up according to the invention with a reeling slide and a reeling carriage. The reel-up 1 comprises supporting structures 2 located behind a reeling cylinder 5 in the travel direction of the web W. The supporting structures 2 are composed of structures located in the vicinity of both ends of the reeling cylinder. The supporting structures 2 for supporting the reel spool and the roll (reel 11 or 12 in FIG. 2*a*) that is being formed, comprise an assembly of supporting devices which comprises at least a part of the bearer surface or a corresponding surface 3 in the upper surface of the supporting structure, on which the reel spool and the roll thereon can roll, and at least a second part of a supporting surface 44, such as a slide 4 or a corresponding arrangement, which supporting surface can be moved with respect to the reeling cylinder from the functional vicinity of the reeling cylinder 5 to the vicinity of the bearer surface of the supporting structure, or a corresponding surface 3. Thus, during the "nip closed" reeling, the reel spool rests on the supporting surface movable by its bearing housing in such a way that their mutual location remains substantially unaltered, while the supporting surface is moved at the same time in accordance with the increase of the diameter of the reel. Advantageously, the movable supporting surface 44 and the bearer surface or a corresponding surface 3 are substantially on the same vertical level. According to the invention, the reel spool and the roll formed thereon (reel 11 in FIG. 2*a*) are supported by means of the supporting surface 44 movable during the reeling process, and during and/or after the reel change the complete reel (reel 12 in FIG. 2*a*) can be rolled from the movable supporting surface to the bearer surface or a corresponding surface and further by means of the bearer surface or a corresponding surface.

Figure 2B:
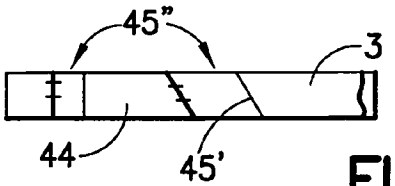
FIG. 2*b* shows as an example a top view of an embodiment of a solution according to the invention, cut at point A—A of FIG. 2*a,*
Figure 3:
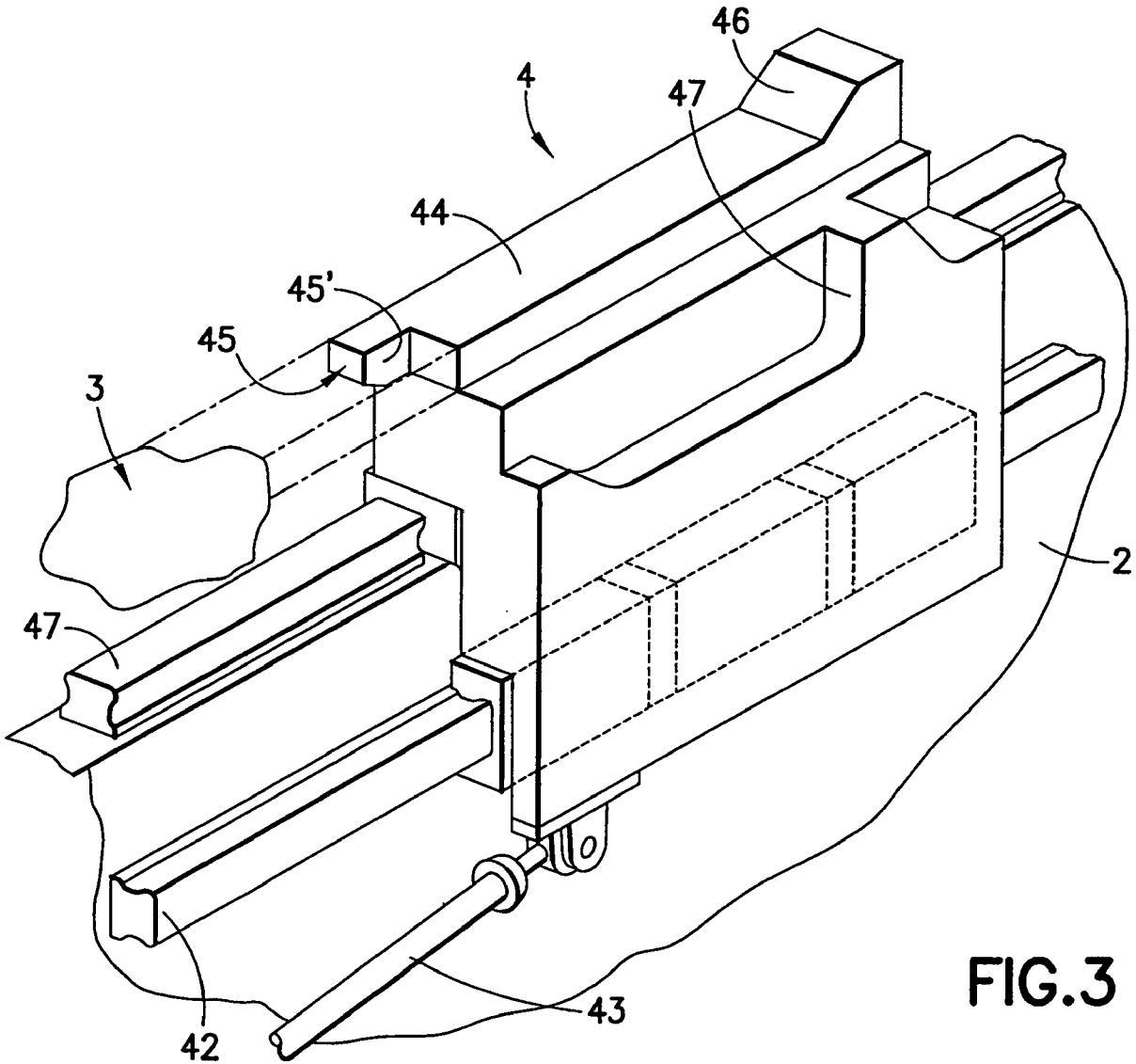
FIG. 3 shows a perspective view of a slide according to a preferred embodiment of the invention, including the supporting surfaces of the slide.

FIG. 3 shows an embodiment of the slide 4 according to the invention. The slide is supported to a supporting structure 2 by means of guides 41 and 42, which are arranged in such a way that one of them is on the vertical surface of the supporting structure (supporting structure 2 in FIG. 2*a*) and the other on the upper surface of the same, wherein the force control is optimal. The reel that is being formed weighs tens of tons, and thus the structure has to be very steady and strong. The slide 4 comprises a supporting surface 44 which is, according to the invention, substantially as wide as a fixed rail section 3, which is here pictured close to the slide, even though it is, in fact, further apart. The respective surfaces 45 of the fixed rail section 3 and the supporting structure 44 of the slide have such a shape that when the slide is brought in contact with the fixed rail section, a connective seam section 45' is formed, extending at least a length substantially in the direction of the rail, which connective seam section 45' can also lie in a particular angle with respect to the fixed rail section. FIG. 2*b* shows a partial vies of a second embodiment of the connective seam 45'. FIG. 2*b* also shows end damping elements 45" such as rubbers, for softening the connective action. The slide 4 has such a shape that the supporting surface comprises a camber 46 in the end by the reeling cylinder.

Furthermore, the slide is also provided with a space 47 for a locking jaws of the reel spool. The slide also comprises mechanical locking devices for locking the reel spool in connection with the slide.

The slide is arranged movable on linear guides 41 and 42, which can support the mass of the entire machine reel. The slide is provided with e.g. an pressurized air cylinder control 43, by means of which it can e.g. be restored to the initial position (to the front) for a new reel spool. The supporting surface of the reeling slide 4 can also be placed in an angle, which is e.g. 1° to 3°, wherein part of the linear load is produced with the mass of the reel spool itself. The path of motion of the slide is arranged in such a way that it is sufficient for the reeling of a maximum size machine reel. The slide can also be arranged to be supported with one guide.

In the situation of FIG. 2*a*, the new reel spool 11 is lowered on the slide 4, and the full reel 12 has been delivered to be supported by the fixed rail section 3. The reel change is conducted and the reeling is continued on the support of the slide. According to the invention, the entire reeling process with the nip of the reeling cylinder closed is conducted without rolling the reel spool on the rails. In a change situation where the full reel is transferred on the support of the fixed rail section, the time used for reeling onto the full reel is so short that it is not substantially necessary to roll the reel spool during the reeling. In the "nip open" reeling, a separate pressing device is brought in contact with the reel.

FIGS. 4*a* to 4*e* also show the principle of the method according to the invention by utilizing only those parts in the reel-up of a paper web which are essential in view of the invention. On the basis of the description, it is, however, possible to apply the invention. FIGS. 4*a* to 4*e* schematically illustrate a reel-up 30 of which only some of the components are shown for the sake of clarity. With the reel-up, the web W travelling from a paper machine is reeled to form a reel R. The reels are formed around reel spools and the reel spools are advantageously provided with centre-drives. During the reeling, the reel that is being formed is supported with an apparatus, reeling carriages 33, which comprise means 36 for supporting the reel spool, such as locking jaws and/or controllers.

Figure 4A:
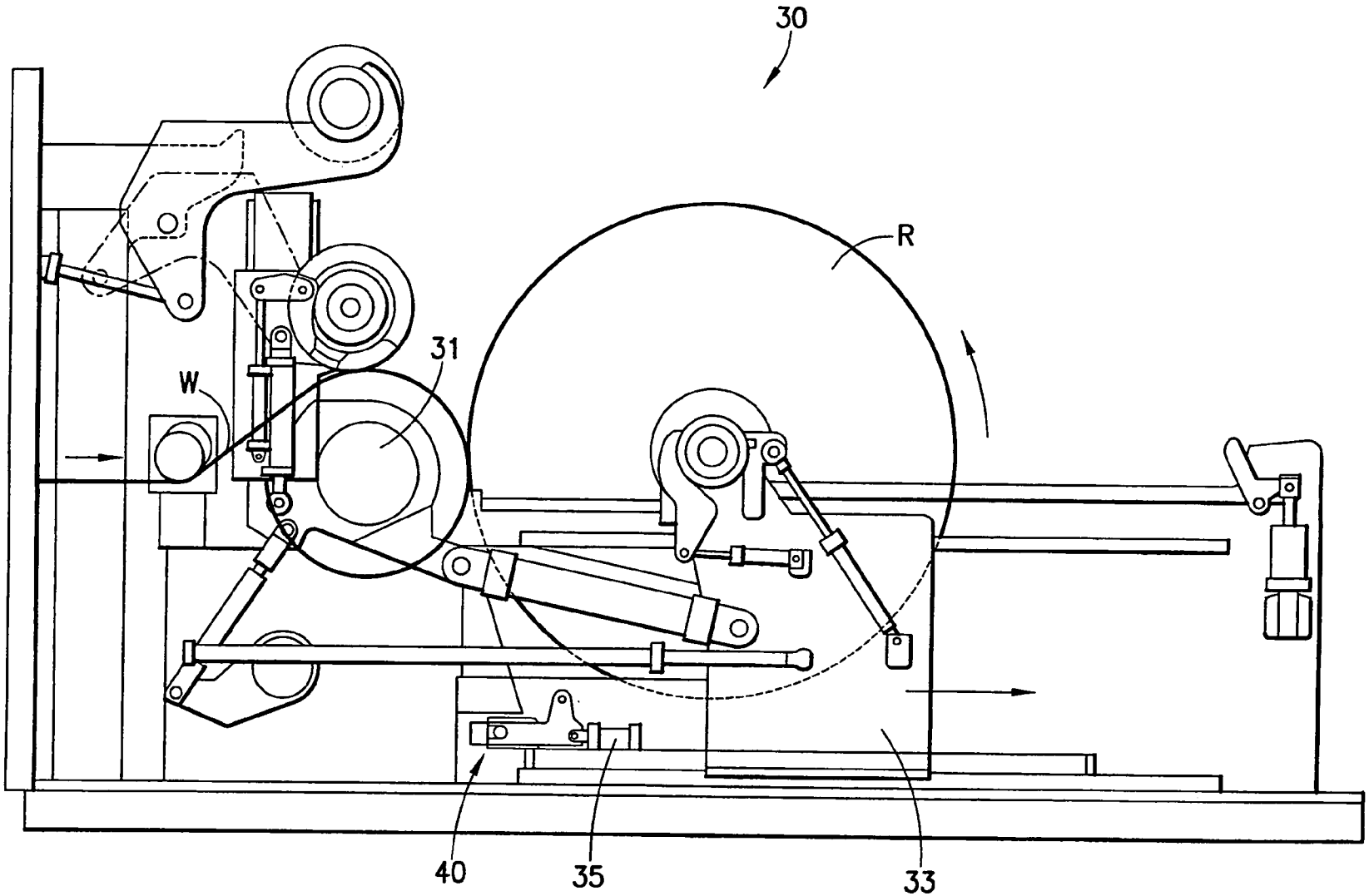
FIGS. 4*a*–4*e* show a schematical side view of a reeling solution according to the invention and a method in connection of the reeling.
Figure 4B:
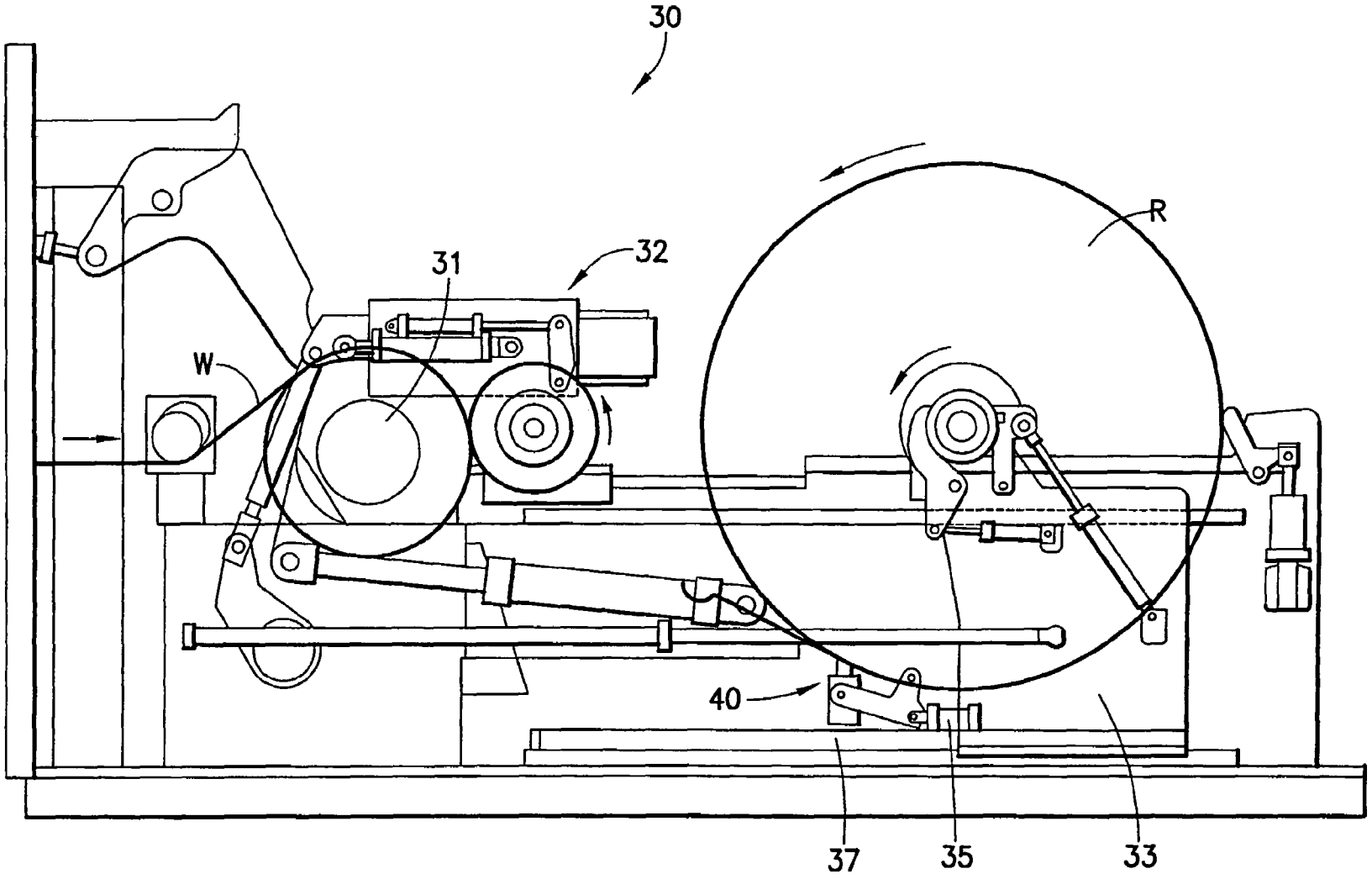
Figure 4C:
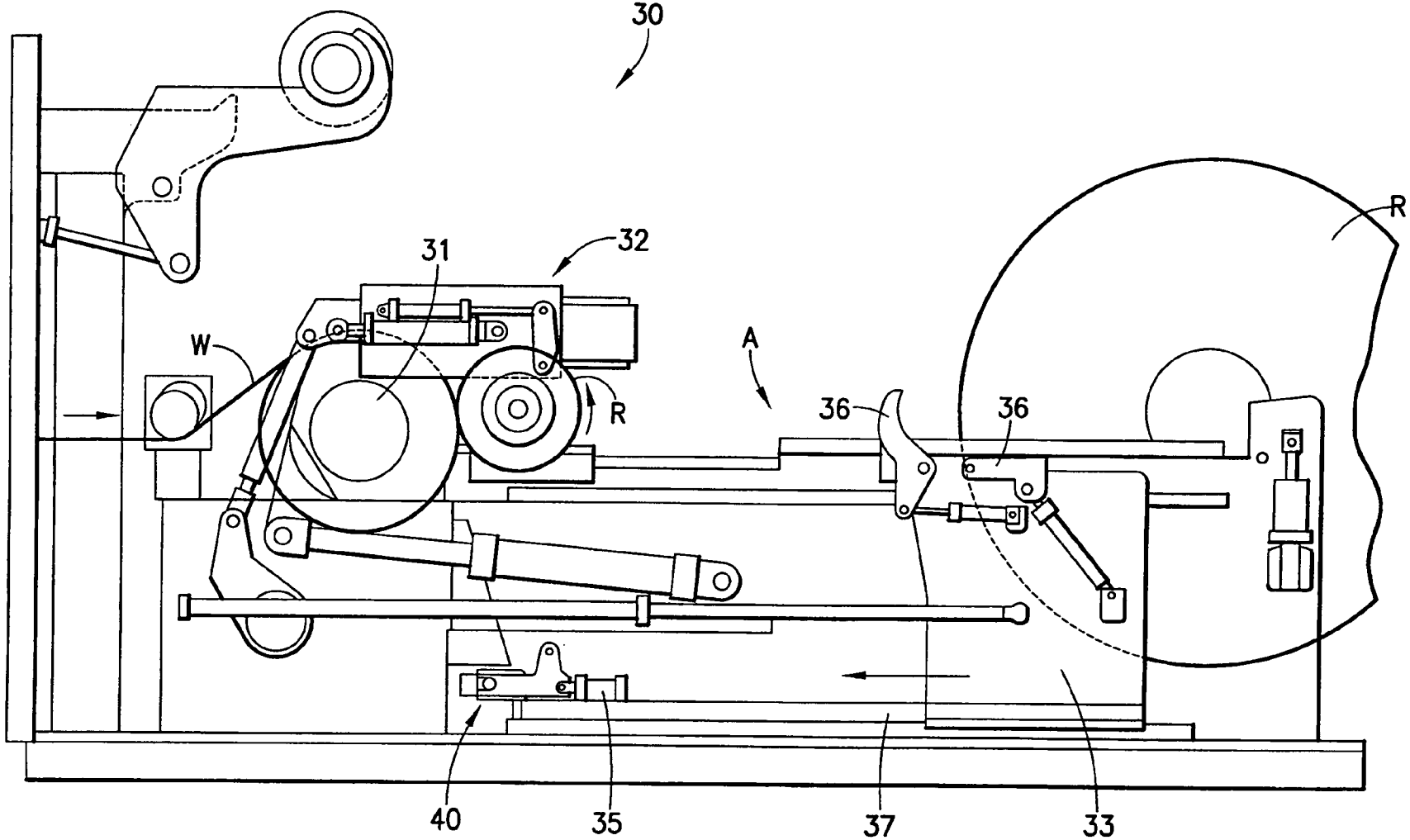
Figure 4D:
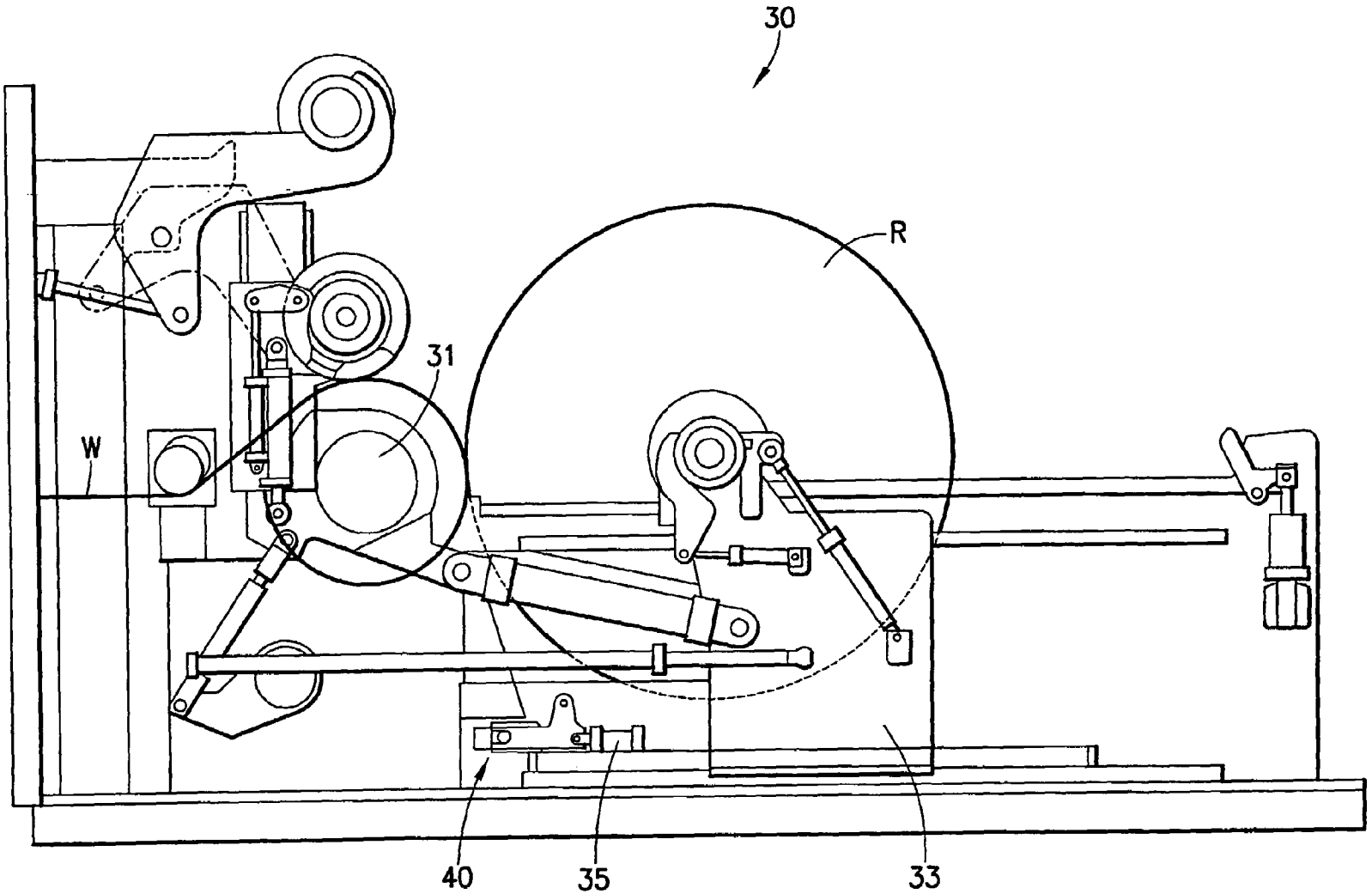
Figure 4E:
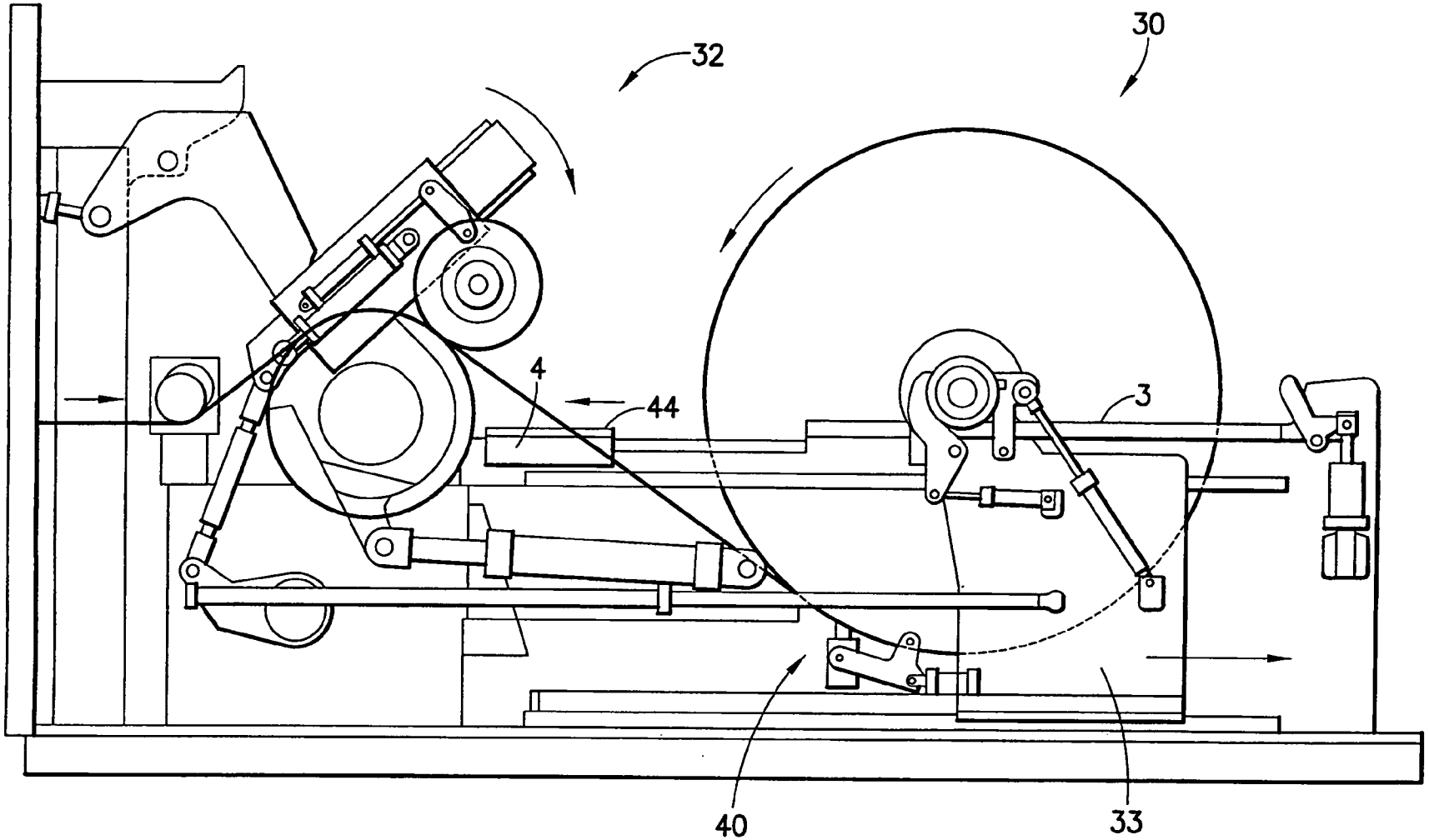

According to FIG. 4*a*., the reel formed during the reeling accumulates, wherein the reel spool and the roll are moved with respect to the reeling cylinder 31 according to the need. Here, the transfer of the reel is described, but it is also possible to move the reeling cylinder 31, wherein an auxiliary nip is formed with a pressing roll 34. According to the invention, the pressing roll 34 is coupled to the reeling carriage to be moved in a synchronized manner, and it is advantageously directly attached to the reeling carriage or to a member 37, such as a supporting bar or the like, located in connection with the same. It should be understood that both ends of the reel (front side and driving side) are provided with similar kinds of solutions. The pressing roll 34 is arranged to be movable in a supporting bar 37, wherein it can perform a linear motion. The motion of the pressing roll and its loading against the reel is effected by means of a force device 35, which can be a hydraulic cylinder or a corresponding cylinder. The method of driving the reel-up according to FIGS. 4*a* to 4*e*, is implemented in the following way. Primarily, it is essential that the arrangement 33 supporting the reel at least during the change, such as a reeling carriage or the like, is driven to the vicinity of the reeling cylinder substantially immediately after the reel change, wherein the "home station" of the reeling carriages and the pressing device, advantageously a roll attached thereto, is in the front in the vicinity of the reeling cylinder substantially immediately after the reel change, wherein the "home station" of the reeling carriages and the pressing device, advantageously a roll attached thereto, is in the front in the vicinity of the reeling cylinder. According to FIG. 4*b*, the pressing roll supported to the reeling carriage at the change situation is driven into nip contact with the reel by means of the force device 35. When the change has been conducted, and the full reel is at least mainly stopped (wherein the auxiliary nip on the roll 34 can be opened), the controllers and/or locking jaws 36 of the reeling carriage are lowered down, and the reeling carriage and thereby also the pressing roll are driven to the vicinity of the reeling cylinder according to FIG. 4*c*. At the same time, the reeling is already in process, e.g. by means of an initial reeling device 32. Here, the initial reeling device is arranged to be turnable in the vicinity of the reeling cylinder, but it can also be a device functioning primarily in linear motion and carrying the reel spool "downwards from an upper position". The reeling is effected for a suitable period of time on the support of the initial reeling device according to FIG. 4*c*, and during this time the reeling carriage with its pressing rolls is driven to the vicinity of the reeling cylinder, wherein the area A between/behind the supporting structures/reel-up is free, and it is possible to move therein without being hampered by the mechanisms of the pressing roll and the reeling carriage. In a situation according to FIG. 4*d*, the support as well as the loading of the reel are transferred from the initial reeling device 32 to the reeling carriage 33. In FIG. 4*d*, a new reel spool is also transferred by means of the initial reeling device to the vicinity of the reeling cylinder, and in this situation the reel has also had time to grow. Here, the pressing roll is still detached from the nip contact, but it can be driven in contact with the surface of the reel when necessary by means of the force device 35. It is possible to use a so-called brush pressing device 40 to form the auxiliary nip, which is shown in FIGS. 4*a* to 4*e*. FIGS. 4*a* to 4*e* show a method according to the invention applied in connection with the supporting surface 44 and the slide 4 according to the invention, wherein the situation in the transfer of the slide 4 shown in FIG. 4*e*, precedes the situation of FIG. 4*c*, so that a new reel spool could now be lowered with the initial reeling device onto supporting surface 44, and the reeling could be continued for a while by means of the initial reeling device. It is obvious that the method according to the invention can also be applied in connection with a reel-up according to FIG. 1, equipped with a continuous rail-like rolling surface K2.

It is obvious for anyone skilled in the art that the invention is not restricted solely to the embodiment presented above, but it can vary within the scope of the claims.

What is claimed is:

1. Reel-up of a web comprising:

reeling means for guiding a web onto a reel spool to thereby form a reel;

supporting structures having a fixed bearing surface for supporting said reel spool having a reel being formed or a complete reel thereon, and along which said reel spool or said complete reel can roll; and a slide having a supporting surface structured and arranged to retain said reel spool having a reel being formed or said complete roll thereon, and along which said reel spool being formed or said complete roll can roll wherein said slide is movable for having a variable space between said reeling means and said slide; and wherein said slide is movable from a functional vicinity of the reeling means for moving said reel spool having a reel being formed away from said reeling means during the reeling process, to a vicinity of said fixed bearing surface, for rolling said reel spool having a reel being formed or said complete roll from said supporting surface on to said fixed bearing surface.

2. Reel-up according to claim 1 wherein said supporting surface and said fixed bearing surface are structured and arranged substantially on the same vertical and horizontal planes.

3. Reel-up according to claim 1 wherein, said slide is structured and arranged to be supported by said supporting structures.

4. Reel-up according to claim 3 wherein said supporting surface is provided with a mating surface formed on an end thereof and wherein said fixed bearing surface is provided with a corresponding mating surface formed on an end thereof such that when said slide is brought in contact with the said fixed bearing surface, a mating section is formed therebetween, said mating section extending on at least a length of said supporting surface and said fixed bearing surface.

5. Reel-up according to claim 1 wherein said supporting surface is structured and arranged to have a width equal to a width of said fixed bearing surface.

6. Reel-up according to claim 1, wherein said supporting surface is structured and arranged to be a rolling surface on which said reel spool can roll and move with respect to said supporting surface.

7. Reel-up according to claim 1, wherein said supporting surface is structured and arranged to form an extension of said fixed bearing surface, whereby said reel spool can be moved from said supporting surface to said fixed bearing surface by rolling.

8. A method for reeling a web in a reel-up, comprising the steps of:

providing a reel spool, each reel spool having a pair of opposed ends;

providing reeling means for guiding said web on to said reel spool, said reel spool and said reeling means defining a reeling nip therebetween;

supporting said pair of opposed ends of said reel spool on a slide having a supporting surface when said reeling means and said reel spool are in a nip closed position and along which supporting reel spool can roll, wherein said slide is movable for having a variable space between said reeling means and said slide;

forming a reel on said reel spool; and changing the position of said reel with respect to said reeling means, as said reel is being formed on said reel spool being supported on said supporting surface.

9. Method according to claim 8, further comprising the steps of:

providing a reeling carriage for supporting said reel during a change of said reel;

providing a pressing device in the form of a roll attached to said reeling carriage, and driving, substantially immediately after said reel change, said reeling carriage to the vicinity of said reeling means.

10. Method according to claim 9, further comprising the step of:

starting the reeling on a new reel spool before said reeling carriage is driven to the vicinity of said reeling means.

11. Method according to claim 9, further comprising the steps of:

reeling, after said reel change, said web with a support of a primary reeling device for a suitable period of time; and driving said reeling carriage together with said pressing device to the vicinity of said reeling means during this period of time.

12. The method according to claim 8, further comprising the step of:

sliding said slide away from said reeling means as said reel being formed on said reel spool grows in diameter.

13. The method according to claim 8, further comprising the step of:

providing a fixed bearing surface structured and arranged to receive said reel spool from said supporting surface thereon, wherein said supporting surface is provided with a rolling surface vertically aligned with said fixed bearing surface such that said pair of opposed ends of said reel spool can roll from said supporting surface to said fixed bearing surface.

14. The method according to claim 13, further comprising the step of:

during a reel spool change situation;

sliding said slide, having a full reel spool supported thereon, along rail members; and rolling said full reel spool from said supporting surface to said fixed bearing surface.

15. The method according to claim 8, further comprising the step of:

placing an empty reel spool onto said supporting surface at an initial stage of the reeling process.

16. The method according to claim 8, further comprising the steps of:

during a reel spool change situation:

opening said nip closed position by sliding said reel spool away from said reeling means; and transferring said reel spool from said supporting surface to rail members structured and arranged to receive said opposed ends of said reel spool.

17. The method according to claim 8, further comprising the steps of:

during a reel spool change situation:

sliding said slide into an initial position in the vicinity of said reeling means; and transferring a new reel spool on to said supporting surface.

* * * * *